US005289923A

United States Patent [19]

Coblentz et al.

[11] Patent Number: 5,289,923

[45] Date of Patent: Mar. 1, 1994

[54] STACKER FOR ELECTRONIC PAYMENT SYSTEM KEY PAD AND PRINTER

[75] Inventors: Fred C. Coblentz, Lake Forest; William D. Watt, Walnut, both of Calif.

[73] Assignee: Atlantic Richfield Company, Los Angeles, Calif.

[21] Appl. No.: 979,990

[22] Filed: Nov. 23, 1992

[51] Int. Cl.[5] ..... A47F 7/00

[52] U.S. Cl. ..... 211/13

[58] Field of Search ..... 211/13, 50, 59.2; 248/346, 176

[56] References Cited

U.S. PATENT DOCUMENTS

| | | | |
|---|---|---|---|
| 1,458,953 | 6/1923 | Robeson | 211/50 X |
| 2,799,399 | 7/1957 | Cannon | 211/59.2 |
| 4,066,171 | 1/1978 | Fowlie | 211/13 X |
| 4,544,065 | 10/1985 | Mueller | 211/13 |
| 4,570,802 | 2/1986 | Murphy | 211/13 |
| 4,828,118 | 5/1989 | Dearien | 211/13 X |

*Primary Examiner*—Robert W. Gibson, Jr.
*Attorney, Agent, or Firm*—Joseph E. Rogers

[57] ABSTRACT

An article of manufacture for providing easy access to electronic key pads and magnetic card readers is provided. The article includes recessed areas for the holding of such key pads and printers at suitable angles to afford easy access and reduces the amount of counter space necessary to utilize such equipment.

5 Claims, 4 Drawing Sheets

STACKER FOR ELECTRONIC PAYMENT SYSTEM KEY PAD AND PRINTER

CROSS REFERENCES TO RELATED APPLICATIONS

This Application is cross-related to U.S. patent application Ser. No. 29/001,773 entitled a "Stacker for Electronic Payment System Key Pad and Printer " by Fred Coblentz and William Watt; U.S. Design Patent Application Ser. No. 29/0-001,771 entitled "Stacker for Electronic Payment System Kdy Pads" by William Watt and Fred Coblentz; and Utility Application Ser. No. 07/981,661 entitled "Stacker for Electronic System Key Pad" by William Watt and Fred Coblentz, all of which are owned by a common assignee."

FIELD OF THE INVENTION

This application relates to an article of manufacture used to hold and provide access to electronic key pads and printers.

BACKGROUND OF THE INVENTION

Retail establishments and other commercial outlets usually permit several different options for payments for goods and services. Traditionally, these have included cash, check, and credit card. More recently, certain outlets now permit the use of debit cards which transfer funds from the customer's account to the seller's account electronically through the use of a debit card.

Debit cards owe their efficiency to communications systems which link directly various banks and retail establishments. The vehicle by which the customer debits his account is a credit-card-like card, having a magnetic strip and certain information stored on that magnetic strip. Typically, the debit card is slid through a magnetic card reader, either by the customer or by the seller. Customer then enters a secret personal identification number on a keypad which, when verified, will permit the debiting of customer's account and the crediting of seller's account.

With the advent of this form of payment, as well as the improved data communication system which currently exists for communication between retail outlet and banks with respect to authorizations for credit card customers and with third party check verifiers there has been an increase in the amount of counter space taken up by these electronic devices.

To complicate matters even further, in some outlets sellers desire that their employee slide the credit card through the reader and enter an identification number as well as an amount to obtain credit authorization, at the same time they are checking the signature of the card holder. In addition, with the increased use of debit cards as a replacement for cash, there is a movement to insure that customer does not need to relinquish his debit card to seller or seller's employees.

Both employee and customer need access to key pads. Thus, the current situation has increased the numbers of electronic devices needed at the checkout counter.

More and more of such systems are being used by retailers for whom counter space is at a premium and resulting in customer spending additional time in checkout lines. These problems are especially acute for small retailers with limited counter space. Thus, there is a need for a compact and inexpensive holder for a number of key pads and printers.

SUMMARY OF THE INVENTION

Applicants' terminal stacker consists of stacker whose base is comprised of a first holder and a second holder, connected together back to back, where you can put a key pad on each holder a first holder having a first face connected to and forming a first acute angle between the base and the first face and having portions defining both a first recess and a first slot opening into the first recess; a second holder having a second face connected to and forming a second acute angle between the base and second face, connected to the first face and having portions defining a second recess facing in a substantially opposite direction from the first side having portions defining a second slot opening into the second recess; and a third holder having a third face connected to and forming a third acute angle between the base and third face, connected to the first face and having portions defining a third recess facing in a substantially opposite direction from the first side.

This invention aids is solving the problems discussed above and has several additional advantages. The terminal stacker provides for an efficient height and angle for easy data entry into both the seller and customer keypad, and easy access to the printer thereby improving efficiency at checkout.

FIGURES

Applicants' invention can be understood by using the description of the preferred embodiments provided below in conjunction with the attached figures wherein.

DESCRIPTION OF THE PREFERRED EMBODIMENT

Figure 1:
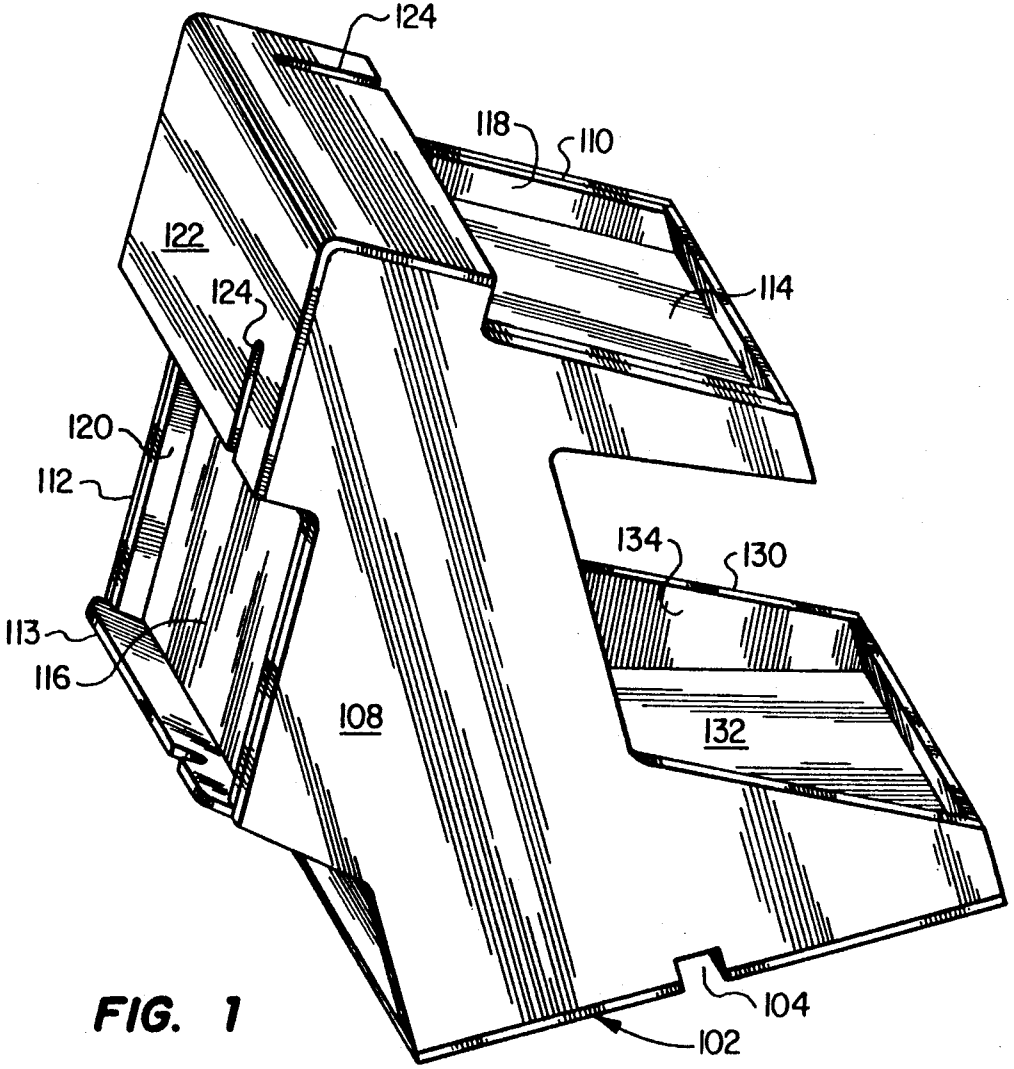
FIG. 1 is a front perspective view of a holder for an electronic payment system key pad and printer.

FIG. 1 shows a front perspective of a terminal stacker 100 for an electronic payment system key pad 100. For the purposes of this description, terminal stacker 100 will be described in terms of component parts, but applicant's invention may be formed in a single injection or molding process as are well known in the art. Terminal stacker 100 may be constructed of any one of a number of materials, including but not limited to, plastic, plexiglass, or other similar material, and may be either a single piece or a series of components which are attached one to the other by means of either fasteners or glue or some other suitable attaching means which are well known in the art.

Figure 6:
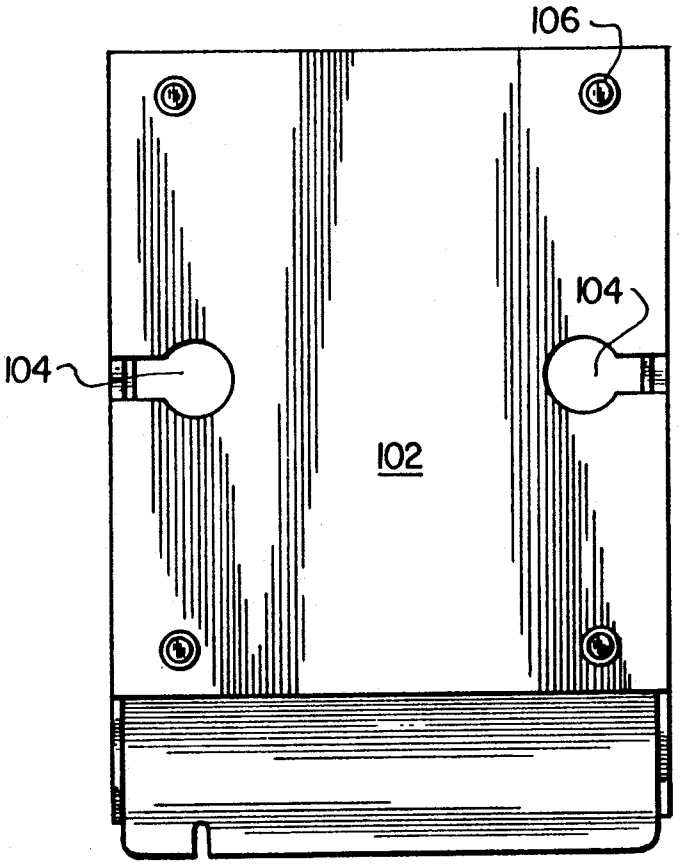
FIG. 6 is a bottom plan view thereof.

Terminal stacker 100 has a base 102 shown in both FIG. 1 and FIG. 6. Base 102 has two holes 104, which permit cable access from the bottom of terminal stacker 100 to the various electronic devices in terminal stacker 100. In addition, base 102 has several feet 106 attached to it. These feet can be made several different materials including but not limited to plastic or rubber or other materials as are well known in the art.

Figure 3:
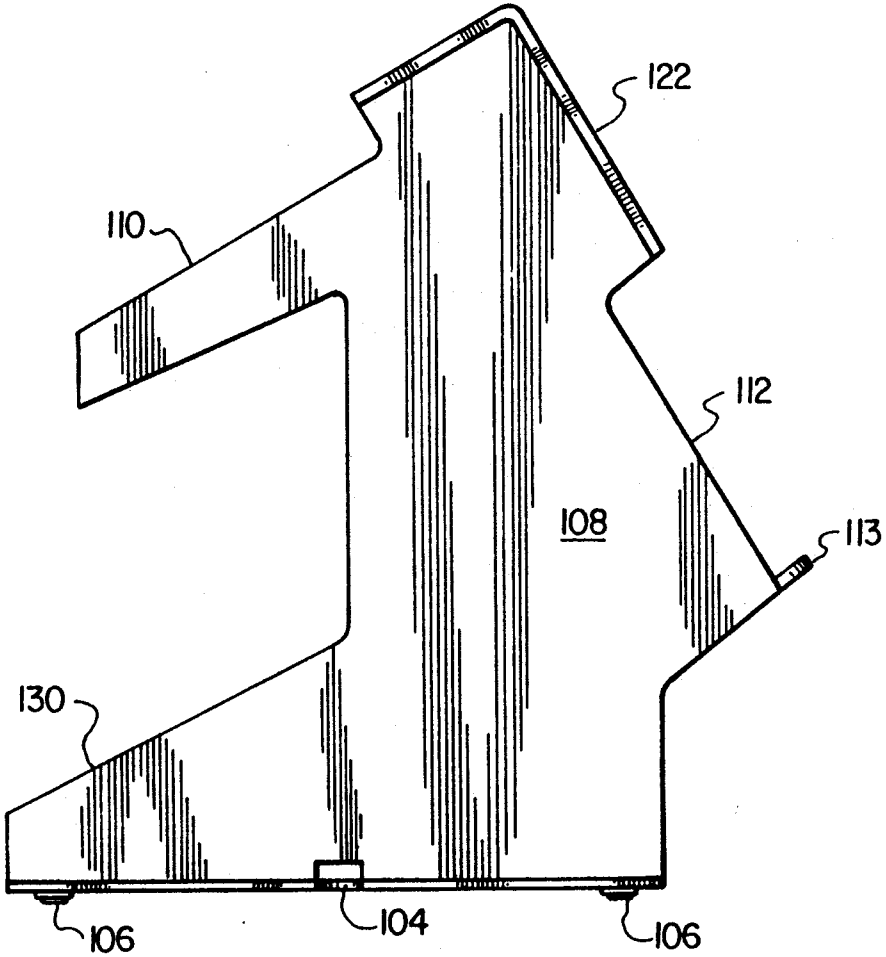
FIG. 3 is a left side elevational view thereof, the right side elevational view being a mirror image thereof.

As can be seen in FIGS. 1, 3, and 6, holes 104 also extend through sidewall 108 to provide not only for bottom but also side access of cables. This affords the user the option and advantage of either concealed cables entering into terminal stacker 100 through the bottom or side entry of cable.

Sidewall 108 is attached to base 102 as shown and provides a cable access hole 104 as indicated above.

FIG. 3 is a left side elevational view of the holder, the right side elevational view being a mirror image thereof. Sidewall 108 has a first face 110 and a second face 112 as shown in FIGS. 1 and 3. A first recessed area 114, having sidewalls 118 formed using either sidewall 108 or a tray or some other suitable fixture attached to sidewalls 108 is positioned parallel to face 110. Front plate 113 is attached and perpendicular to base 102 and sidewall 108. Front 113 protrudes above the plane at second face 112.

Figure 7:
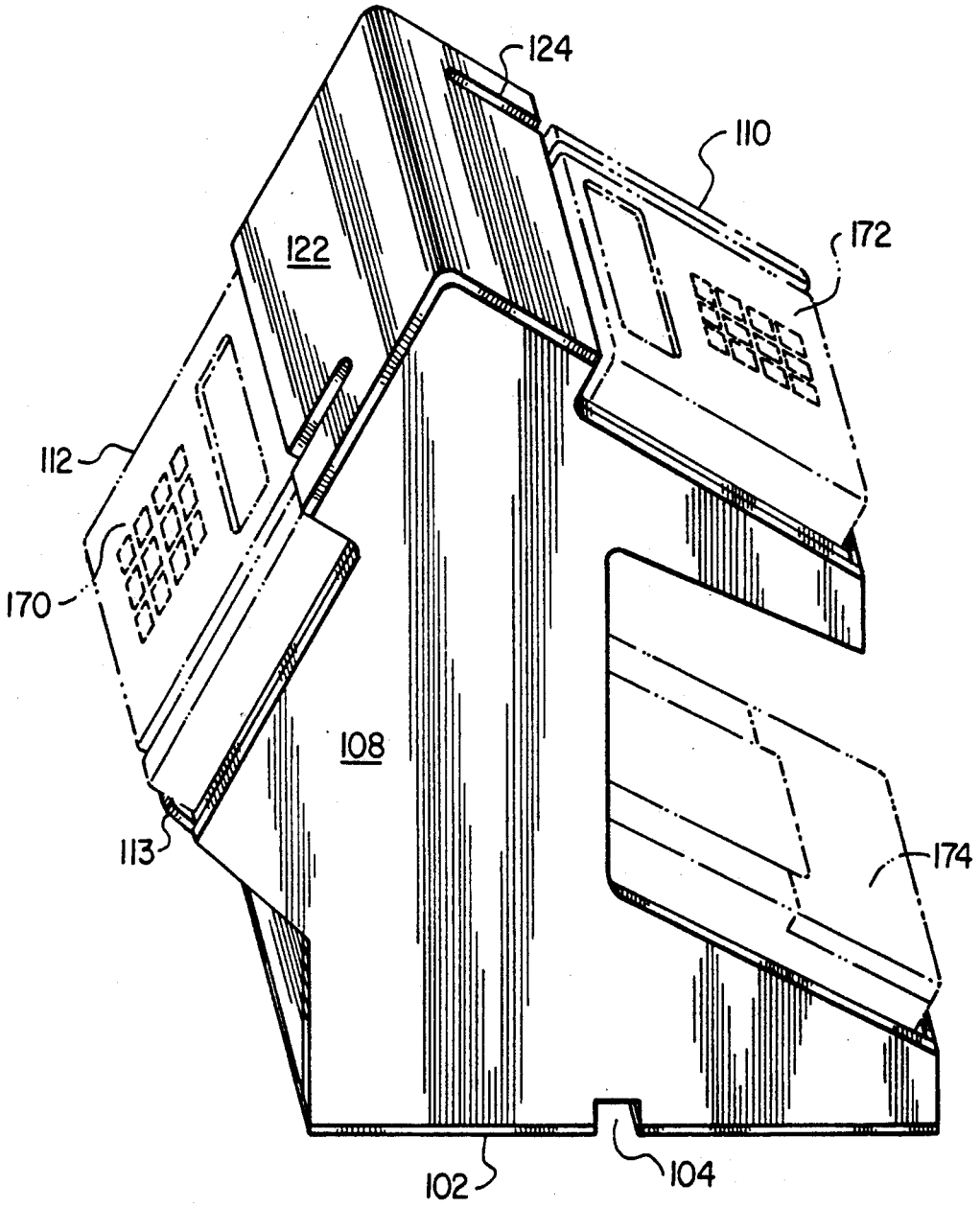
FIG. 7 is a front perspective view of a holder for an electronic payment system key pad and printer with the key pads and printer shown in phantom.

In a similar fashion, a second recess 116 is formed on the opposite of terminal stacker 100 having sidewalls 120 which may be formed either by sidewall 108 or by a tray suitably attached to sidewall 108. Each of these recesses is sized for key pads 170 and 172 which are currently available and are well known in the art including but not limited to the Verifone Trans 330 and Verifone 201 key pads as are shown in FIG. 7. Notice that front plate 113 protrudes above the level of plane 112 to cause the top of key pad 170 to engage between top 122. This engagement of key pad provides the advantage of securing the key pad to the holder.

Figure 2:
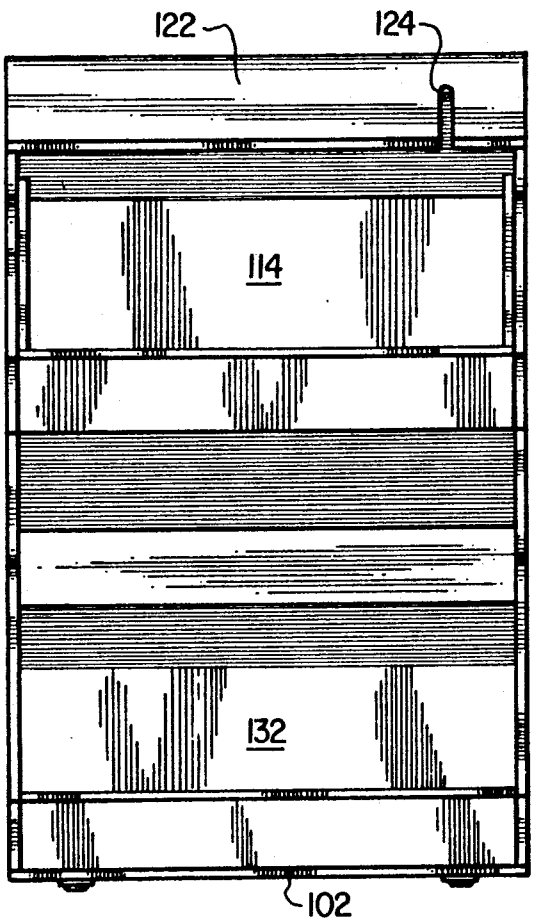
FIG. 2 is a front elevational view thereof.

As shown in FIGS. 1, 2 and 3 sidewall 108 forms face 130 which is some suitable spacing below and at a suitable angle with the base and with face 110. Recess 132 having sidewall 134 can be either formed the sidewalls 108 or a suitably sized tray attached to sidewalls 108. Recess 132 can be used to hold a printer associated with the key pads and pin pads which are well known in the art including the Verifone 250 roll printer. The exact spacing an angle depend upon such consideration as the type key pads and printer and the height of the counter.

Figure 5:
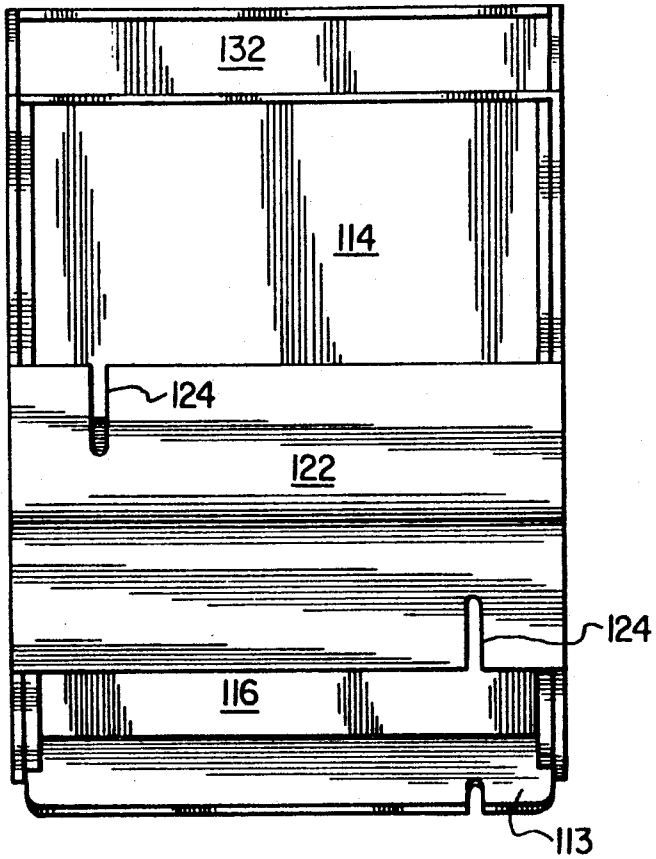
FIG. 5 is a top plan view thereof.

Terminal stacker 100 also includes a top member 122 between the two sidewalls 108 and above recesses 114 and 116 as clearly shown on FIGS. 1 and 5. FIG. 5 is a top plan view of the holder.

Figure 4:
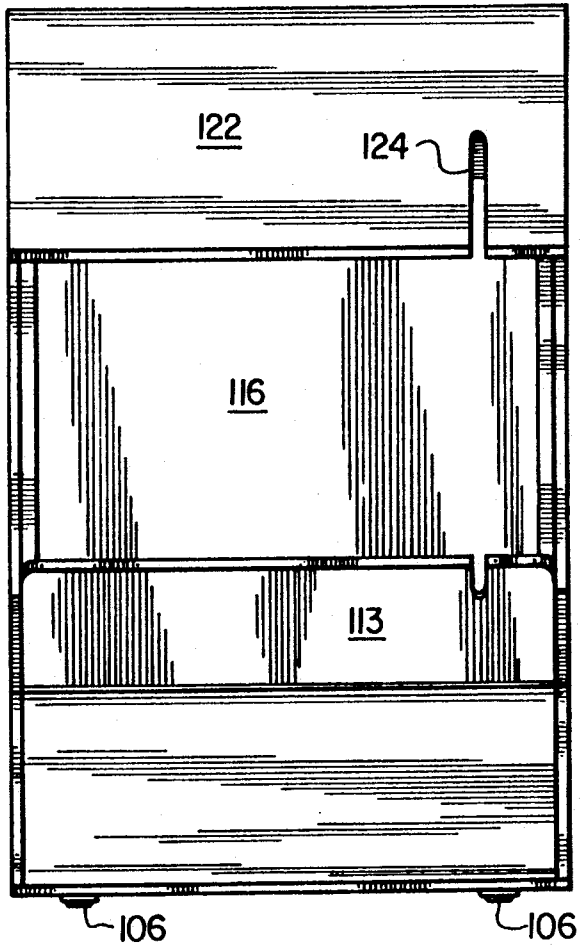
FIG. 4 is a rear elevational view thereof.

Slots 124 as shown on FIGS. 2 and 4 are positioned in top 122 to easily permit access to the magnetic card reader in the key pads which are in use.

In operation, referring to FIG. 7, a debit or credit card would be slipped in through slot 124 to key pad 170. Customer could then enter his personal identification number to complete the transaction. Alternatively, in a credit card transaction, seller's employee could slide the credit card through slot 124 and key pad 172. Seller's employee could then enter the amount and any necessary security or identification codes. When either transaction was complete a receipt or signable document could be provided by the printer 174. In addition, the angle of face 110 and 112 is designed to provide easy access to the entry keys of each of the pin pads.

Although several embodiments have been described in detail, it should be understood that various changes, substitutions and alterations can be made therein without departing from the spirit and scope of the invention as defined by the appended claims.

What is claimed is:

1. A terminal stacker having a base comprising:

(a) a first holder having a first face connected to and forming a first acute angle between the base and the first face and having portions defining both a first recess and a first slot opening into the first recess;

(b) a second holder having a second face connected to and forming a second acute angle between the base and second face, connected to said first face and having portions defining a second recess facing in a substantially opposite direction from the first holder having portions defining a second slot opening into the second recess;

(c) a third holder having a third face connected to and forming a third acute angle between the base and third face, connected to said first face and having portions defining a third recess facing in a substantially opposite direction from the first holder; and (d) a front plate connected to and forming a fourth acute angle with the first face and protruding above the plane of said first face.

2. The terminal stacker of claim 1 wherein said first slot has an axis which is perpendicular to the first recess and parallel to the plane of said first face.

3. The terminal stacker of claim 1 wherein said second slot has an axis which is perpendicular to the second recess and parallel to the plane of said second face.

4. The terminal stacker of claim 1 wherein the first, second, third and fourth acute angles are equal.

5. The terminal stacker of claim 1 wherein the first, second, third and fourth acute angles are approximately 45°.

* * * * *